US005888003A

United States Patent [19]

Pierpont

[11] Patent Number: 5,888,003

[45] Date of Patent: Mar. 30, 1999

[54] COSMETIC CONTAINER HAVING AN INNER SLEEVE FOR CREATING TORQUE

[76] Inventor: Robert L. Pierpont, 65 Mildred Rd., Meriden, Conn. 06450

[21] Appl. No.: 796,662

[22] Filed: Feb. 5, 1997

[51] Int. Cl.[6] ..... A45D 40/04; A45D 40/12

[52] U.S. Cl. ..... 401/78; 401/80

[58] Field of Search ..... 401/78, 80

[56] References Cited

U.S. PATENT DOCUMENTS

| | | | |
|---|---|---|---|
| 2,212,573 | 8/1940 | Peterson . | |
| 2,471,483 | 5/1949 | Frydlender . | |
| 2,630,215 | 3/1953 | Lynn . | |
| 2,725,140 | 11/1955 | Thompson . | |
| 2,797,803 | 7/1957 | Hopgood . | |
| 2,798,598 | 7/1957 | Abbotts . | |
| 3,124,244 | 3/1964 | Hopgood . | |
| 5,096,318 | 3/1992 | Susini et al. . | |
| 5,234,275 | 8/1993 | Gueret | 401/80 X |
| 5,324,126 | 6/1994 | Holloway et al. . | |

FOREIGN PATENT DOCUMENTS

| | | | |
|---|---|---|---|
| 1118889 | 11/1965 | Br. Indian Ocean Ter. | 401/80 |
| 3812777 | 10/1989 | Germany | 401/80 |
| 149831 | 10/1978 | Japan | 401/80 |
| 480413 | 7/1992 | Japan | 401/80 |

*Primary Examiner*—Steven A. Bratlie
*Attorney, Agent, or Firm*—Alstron & Bird

[57] ABSTRACT

A cosmetic container, such as a lipstick container, having a tubular inner sleeve rotatable within a tubular outer sleeve and a cosmetic carrier positioned therein. The cosmetic container may be extended and retracted for the application and storage of the cosmetic. The inner sleeve includes a shank defining a longitudinal slot for receiving lugs extending radially outward from the cosmetic carrier and a manually rotatable base. The shank includes at least one radially outwardly facing rib extending circumferentially along at least a portion of the shank. Preferably a plurality of ribs extend from the inner sleeve and are positioned in a flexible region thereof. The outer diameter of the ribs is at least equal to the inner diameter of the outer sleeve to create torque therebetween.

30 Claims, 1 Drawing Sheet

10
12
14
64

32
52
48
44
46
40
42
22
16
24
20
34
30
36
38
60
66
58
54
62
26
64

36
34
38
60
26
68
32
66
30
66
42
42
58
40
52
24
22
66
66
16
56
20
62
64

COSMETIC CONTAINER HAVING AN INNER SLEEVE FOR CREATING TORQUE

FIELD OF THE INVENTION

The present invention is directed to a lipstick container having an inner tubular sleeve including one or more radially outwardly extending ribs which cooperate with an outer tubular sleeve to create torque between the two sleeves when one is rotated relative to the other.

BACKGROUND OF THE INVENTION

The quality of cosmetic containers, such as lipstick containers, is often indicative of the quality of the cosmetic contained therein. From the consumer's standpoint, a high quality lipstick container has a certain "feel" to it, rotating freely due to its relatively low swivel torque but having enough "resistance" or torque to feel "sturdy". It is within this range of preferred torque which cosmetic companies strive to achieve when crafting cosmetic containers.

Conventional lipstick containers include a cosmetic carrier, a tubular inner sleeve, a tubular outer sleeve and a decorative sleeve. The cosmetic carrier supports the lipstick and is generally configured as a sleeve having radially extending lugs on opposing sides and is received within the inner sleeve. The inner sleeve defines longitudinally extending channels on opposing sides wherein the lugs of the cosmetic carrier extend therethrough. An outer sleeve defining a continuous helical channel is positioned about the inner sleeve wherein the lugs of the cosmetic carrier are configured to be received and to traverse along the length of the helical channel. This results in the cosmetic carrier being moved upwardly as the lugs traverse the length of the helical channel when a bottom portion of the inner sleeve is rotated. The decorative outermost sleeve is provided for aesthetic purposes. In operation, a bottom portion of the inner sleeve extends beyond the bottom of the outer decorative sleeve. The user rotates the bottom portion to cause the cosmetic carrier and, hence, the lipstick to extend from the case for applying the lipstick and to retract into the case for storage.

It is particularly desirable to provide a lipstick container having an inner sleeve which may be effortlessly rotated within the outer sleeve but which has enough torque to feel sturdy. The prior art includes several attempts at achieving the desired amount of torque, many of which experience significant shortcomings. For example, many are complicated, relatively expensive to manufacture, require exact tolerances, or experience wear over extended use thereby adversely effecting torque produced between the relatively rotating sleeves.

SUMMARY OF THE INVENTION

It is therefore an object of the present invention to provide a lipstick container which achieves the desired amount of torque between the inner and outer sleeves thereof.

It is also an object of the present invention to proved the desired amount of torque with a design which is effective, can withstand extended use, and is easy to manufacture.

The cosmetic container according to the present invention overcomes the drawbacks and shortcomings of the prior art by providing a cosmetic container which includes an inner sleeve having at least one outwardly, radially extending rib extending circumferentially around at least a portion of the inner sleeve. The inner sleeve includes a shank portion which defines the longitudinal slots through which the lug of the cosmetic carrier extends. A manually rotatable base is also provided at the bottom or distal end of the shank of the inner sleeve and extends, in one embodiment, below the outer sleeve when the inner sleeve is positioned concentrically therein. Preferably, the shank of the inner sleeve includes two spaced apart ribs which are positioned in a flexible region of the shank. The ribs, in cross-section, are preferably annular to reduce the area of contact between the inner and outer sleeves.

The outer diameter of the shank of the inner sleeve, exclusive of the portion with the rib, is less than the internal diameter of the outer sleeve, thereby creating a radial gap between the two sleeves. The outer diameter of the ribs is at least equal to the internal diameter of the outer tubular sleeve. The ribs are preferably positioned in a flexible region of the shank of the inner sleeve. The radial gap permits the base of the inner sleeve to be easily rotated by the user to extend and retract the lipstick carried by the cosmetic carrier within the cosmetic container. Yet, the outwardly extending ribs in a flexible area of the shank provide the requisite torque to produce a smooth and sturdy combination of rotatable sleeves.

BRIEF DESCRIPTION OF THE DRAWINGS

The foregoing and other objects, features, and advantages of the present invention will be made apparent from the following detailed description of the preferred embodiment of the invention and from the drawings, in which.

DETAILED DESCRIPTION

Figures 1, 2, 3:
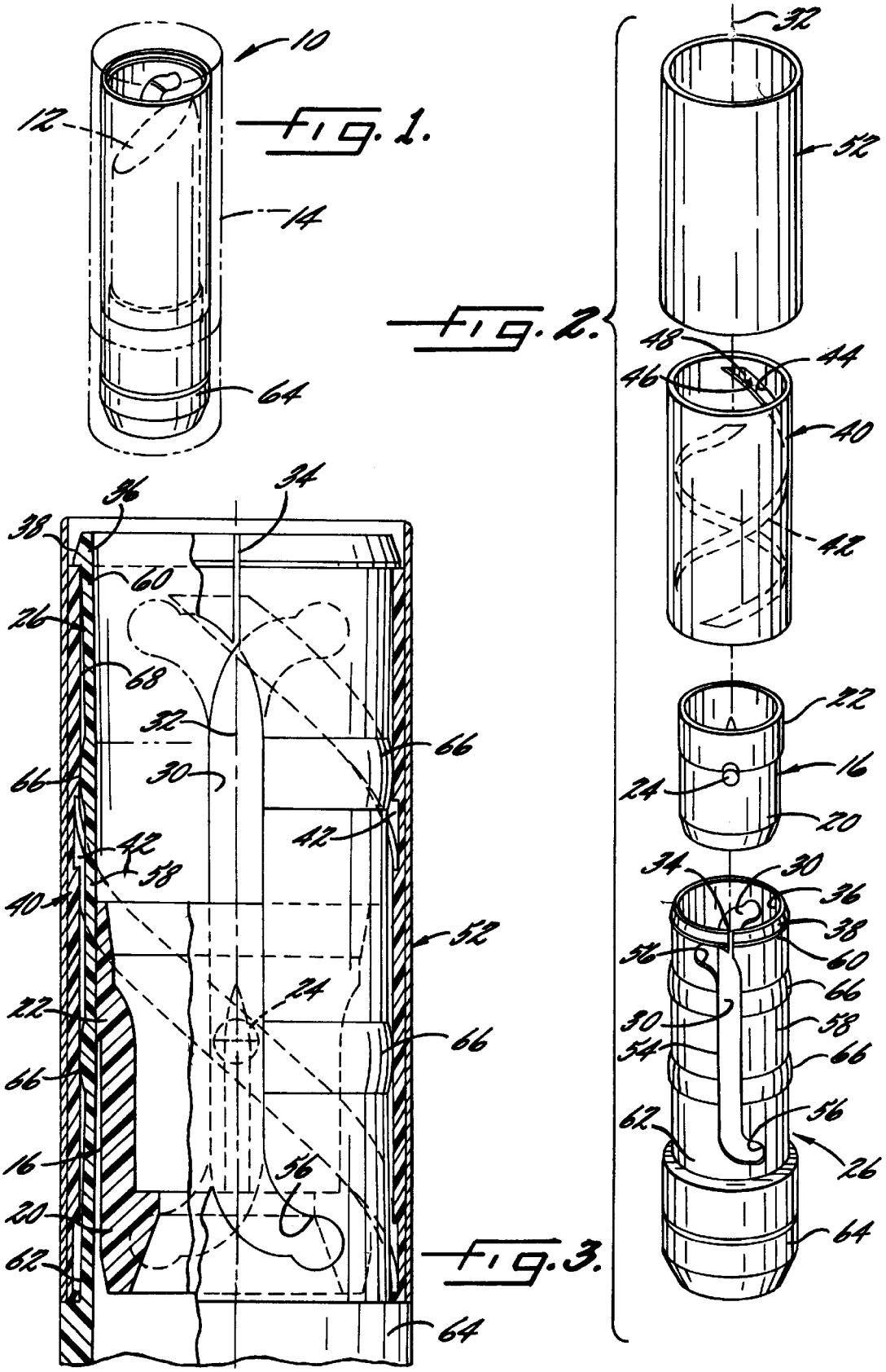
FIG. 1 is a perspective view of a cosmetic container according to the present invention.
FIG. 2 is an exploded view of the cosmetic container of FIG. 1.
FIG. 3 is a partial cross-sectional view of the cosmetic container of FIG. 1.

The present invention will now be described more fully in detail with reference to the accompanying drawings, in which a preferred embodiment of the invention are shown. This invention should not, however, be construed as limited to the embodiments set forth herein; rather, they are provided so that this disclosure will be thorough and complete and will fully convey the scope of the invention to those skilled in the art.

The present invention is shown and described herein as a container for applying cosmetics, such as lipstick. For the sake of brevity, the description which follows will refer to a lipstick container. However, it should be evident that the container has utility in various other areas wherein a product is to be extended from and retracted into a case. For instance, the container may be utilized for any product requiring topical application.

The lipstick container of the present invention, indicated by the reference character 10, is designed for dispensing lipstick 12, shown in phantom, so that it may be cosmetically applied. An outer enclosure 14, shown in phantom, may also be provided as a protective outer enclosure for the lipstick container 10. The lipstick container 10 includes a plurality of tubular members which are concentrically arranged about the longitudinal axis. The lipstick 12 is positioned within a cosmetic carrier 16 to secure the lipstick therein. The cosmetic carrier includes a base 20 and a cylindrical sidewall 22 extending upwardly from the base 20 to define a cup for receiving and holding the lipstick 12. The cosmetic carrier 16 also includes a pair of lugs 24 positioned on diametrically opposing outer surfaces of the cylindrical sidewall 22. Although the lugs 24, as shown, are provided as a pair and are diametrically opposed, it would not be a departure from the scope of the present invention to provide one or any number of lugs in any location along the outer surface of the cosmetic carrier 16.

The cosmetic carrier 16 is positioned within a tubular inner sleeve 26, as best shown in FIGS. 2, 3 and 5. The tubular inner sleeve 26 includes, on opposing sidewalls, a pair of longitudinal slots 30 which extend parallel to the longitudinal axis 32. Positioning of the cosmetic carrier 16 is enhanced by the integral opening 34 provided along the distal portion 36 of the tubular inner sleeve 26. Once positioned within the tubular inner sleeve 26, the cosmetic carrier 16 is movable longitudinally upwardly or downwardly within the inner sleeve 26. The longitudinal slots 30 permit the lugs 24 of the cosmetic carrier 16 to extend therethrough. At its lower end, the tubular inner sleeve comprises a manually rotatable base 64 which will be discussed more fully below.

A tubular outer sleeve 40 is positioned circumferentially around the tubular inner sleeve 26. The outer sleeve 40 has a pair of opposed helical channels 42 formed on the inner surface thereof. The helical channels 42 are defined by opposing upper 44 and lower 46 sidewalls and a bottom wall 48 and are configured to receive at least a portion of the lugs 24 as shown in the various figures.

Positioned circumferentially around the outer sleeve 40 having the helical channel 42 is a tubular decorative sleeve 52. In an alternative embodiment, the outer sleeve 40 and the decorative sleeve 52 may be integrally formed wherein the tubular outer sleeve 52 may constitute the bottom wall of the helical channel 42 and the intermediate sleeve 40 includes a helical slot (not shown) defined by upper and lower sidewalls.

The above described components of the cosmetic container 20 permit easy application of the lipstick by permitting the lipstick to be extended and retracted within the lipstick container 10. The assembly, shown exploded in FIG. 2, is maintained in proper alignment and positioning due to the configuration of the various components. For instance, the proximal portion 36 of the tubular inner sleeve 26 includes a thickened portion extending radially outwardly so as to form a flange. Preferably, the flange forms an annular bearing 38 which supports the inner sleeve 26 concentrically within the outer sleeve 40. Similarly, the rotatable base 64 also forms a flange wherein the inner sleeve 40 and the outer sleeve 52 are retained between the flange 36 and the rotatable base 64.

The operation of the cosmetic container 10 according to the present invention will now be discussed with reference to the various figures. The cosmetic container extends and retracts the lipstick 12 to permit extension thereof beyond the proximal end of the cosmetic container 10 so that it may be applied. The lipstick 12 is propelled within and from the cosmetic container 10 by removal of the outer enclosure 14 and by the rotation of the rotatable base 64 of the inner sleeve 26. Rotating the base 64 in a predetermined direction causes the cosmetic carrier 16 retained therein to likewise rotate due to the extension of the lugs 24 through the longitudinal slot 30 which would, inherently, abut a respective longitudinal side edge 54 defining the longitudinal slot 30 (depending upon the direction of rotation).

Because the lugs 24 are also received, or at least a portion thereof, within the helical channel 42, as the rotatable base 64 of the inner sleeve 26 is rotated, the cosmetic carrier 16 traverses the length of the helical channel 42 of the outer sleeve 40 wherein it moves upward or downward within the longitudinal slot 30. At each of the distal and proximal ends of the longitudinal slot 30 are provided laterally extending locking extensions 56 which, as shown, are formed integrally with the longitudinal slot 30. The locking extensions 56 limit the upward movement of the cosmetic carrier 16 so that, when the cosmetic carrier 16 reaches the uppermost position, it is restrained from further upward movement as further rotatable movement of the base 64 is prohibited. Likewise, at the distal end, when the lipstick 12 within the cosmetic container 16 is fully retracted, further retraction is limited due to the retention of the lug within the laterally extending locking extension 56 of the longitudinal slot 30. Thus, the lipstick 12 may be extended by rotating the rotatable base 64 in one direction, and retracted by rotating the rotatable base 64 in the opposite direction to permit easy application while protecting the lipstick 12 within the container 10 when not in use.

The inner sleeve 26 of the present invention will now be described more fully in detail. Preferably, the inner sleeve is molded of a resilient material, such as plastic. The inner sleeve 26 includes a shank 58 having a proximal end 60 and a distal end 62. The longitudinal slot 30 extends between the proximal 60 and distal ends 62 of the inner sleeve 26. The inner sleeve 26 also includes the base 64 which is positioned adjacent the distal end 62 of the shank 58. As best illustrated in FIG. 3, the base 64 extends a distance below the outer sleeve 40 so as to present a manually rotatable base. Thus, the user may rotate the base 64 to provide relative rotational movement between the inner sleeve 26 and the outer sleeve 40 so that the cosmetic carrier 16 may be extended or retracted to apply the lipstick 12. The inner sleeve 26 is maintained in concentric alignment with the outer sleeve 40 due, at least in part, to the annular bearing 38. The inner sleeve 26 further includes at least one annular rib 66 which extends radially outward from the outer surface of the inner sleeve 26 and circumferentially around at least a portion thereof. As shown, preferably a pair of annular ribs 66 are provided which are positioned within a flexible region of the inner sleeve 26. Of course, any number of ribs may be provided and they may extend circumferentially around only a small portion of the inner sleeve. The ribs 66 are positioned with a predetermined distance therebetween wherein the uppermost rib is adjacent the proximal end 60 of the shank 58 and the other of the ribs 66 is positioned adjacent the distal end 62 of the shank 58.

As best illustrated in FIG. 3, the outer diameter of the ribs 66 are at least equal to the inner diameter of the outer sleeve 40 in an unbiased or unassembled condition such as illustrated in FIG. 2. Accordingly, the ribs 66 close the radial gap 68, in the flexed or assembled condition, defined between the outer diameter of the shank 58 of the inner sleeve 26 and the inner diameter of the intermediate sleeve 40, at least along a portion thereof. In cross section, as illustrated in FIG. 3, the ribs 66 have an arcuate, radial, outer surface defining a convex outer margin to minimize the contact area of the ribs 66 with the inner wall of the outer sleeve 40. Preferably, the annular ribs 66 have an outer diameter which is greater than the inner diameter of the outer sleeve 40 in the unbiased or unassembled condition. This is permissible due to the inherent flexibility of the inner sleeve 26.

In the preferred embodiment, the inner sleeve 26 possesses an inherent flexibility due, in part, to the material selected which is further enhanced by the presence of the longitudinal slots 30. Accordingly, the side walls of the inner sleeve 26 are permitted to flex inward, thereby narrowing the width of the longitudinal slot 30. The inner sleeve 26 possesses an area of maximum flexibility along its length adjacent the middle of the shank 58. The distal end 62 of the shank 58 experiences less flexibility due to its connection with the base 64. Similarly, the proximal end 60 possesses a lesser degree of flexibility than the middle region of the shank 58 due to the uppermost flange 36, albeit, it has greater flexibility than the distal end 62 due to the integral opening 34. In a preferred embodiment, the integral opening 34 also contributes to the flexibility of the shank 58. The ribs 66 are therefore positioned within the flexible region of the shank 58. It is within the scope of the present invention, however, to position the annular ribs 66 anywhere along the shank 58 with the understanding that the nearer the center of the shank 58, the greater the ability of the annular ribs 66 to flex axially inward. This thereby affects the swivel torque of the inner sleeve 26 relative to the outer sleeve 40.

While particular embodiments of the invention have been described, it will be understood, of course, the invention is not limited thereto since modifications may be made by those skilled in the art, particularly in light of the foregoing teachings. It is therefore, contemplated by the appended claims to cover any such modifications that incorporate those features of these improvements in the true spirit and scope of the invention.

That which is claimed:

1. A cosmetic container comprising a first tubular sleeve including a helical channel extending along an inner periphery thereof and having an inner diameter;

a second tubular sleeve having a shank rotatable within said first tubular sleeve, said shank including a flexible region defined by at least one longitudinal slot and comprising at least one radially outwardly facing rib having a length measured in a circumferential direction and a width measured in an axial direction, said length being greater than said width, and extending circumferentially along at least a portion of said shank, said at least one radially outwardly facing rib having an outer diameter which is at least equal to said inner diameter of said first tubular sleeve and being positioned in said flexible region of said shank for creating torque between said first and second tubular sleeves; and a cosmetic carrier movable longitudinally upwardly or downwardly within said first and second tubular sleeves when said second tubular sleeve is rotated relative to said first tubular sleeve.

2. A cosmetic container according to claim 1 wherein said shank further defines an integral opening which extends from a proximal end of said shank to said longitudinal slot.

3. A cosmetic container according to claim 1 wherein said cosmetic carrier includes at least one lug extending radially outwardly from said cosmetic carrier, said lug extending through said longitudinal slot of said second tubular sleeve and having a portion thereof received in said helical channel of said first tubular sleeve so that upon rotation of said second tubular sleeve, said cosmetic carrier is propelled longitudinally upwardly or downwardly within said first tubular sleeve.

4. A cosmetic container according to claim 1 wherein said second tubular sleeve comprises an annular bearing for substantially aligning said first and second tubular sleeves concentrically.

5. A cosmetic container according to claim 1 wherein said second tubular sleeve also includes a manually rotatable base adjacent a distal end of said shank.

6. A cosmetic container according to claim 1 wherein said shank comprises at least two ribs positioned a predetermined distance apart from one another wherein one of said at least two ribs is positioned adjacent a proximal end of said shank and another of said at least two ribs is positioned adjacent said distal end of said shank.

7. A cosmetic container according to claim 1 wherein said at least one radially outwardly facing rib is positioned adjacent a distal end of said shank.

8. A cosmetic container according to claim 1 wherein said outer diameter of said at least one radially outwardly facing rib is greater than said inner diameter of said first tubular sleeve when said second tubular sleeve is in an unbiased condition wherein said at least one radially outwardly facing rib flexes inwardly in a flexed condition when said second tubular sleeve is positioned within said first tubular sleeve for creating torque therebetween.

9. A cosmetic container according to claim 1 wherein said at least one rib includes a convex outer surface.

10. A cosmetic container according to claim 1 wherein said radially outwardly facing rib extends only within the flexible region of said shank.

11. A cosmetic container according to claim 1 wherein said radially outwardly facing rib extends in a direction perpendicular to a longitudinal axis of said second tubular sleeve.

12. A cosmetic container according to claim 1 wherein said radially outwardly facing rib extends substantially along the entire circumference of an outer surface of said second tubular sleeve.

13. A cosmetic container having a longitudinal axis comprising:

a first tubular sleeve including a helical channel extending along an inner periphery thereof and having an inner diameter; and a second tubular sleeve having a shank rotatable within said first tubular sleeve and having a distal and proximal end and comprising a manually rotatable base adjacent the distal end, said shank having a flexible region defined by at least one longitudinal slot and having at least two ribs extending parallel in a circumferential direction perpendicular to the longitudinal axis so as to extend entirely around said shank and outwardly therefrom within said flexible region.

14. A cosmetic container according to claim 13 wherein said at least two ribs each include a convex outer surface.

15. A cosmetic container according to claim 13 further comprising a cosmetic carrier movable longitudinally upwardly or downwardly within said first and second tubular sleeves when said second tubular sleeve is rotated relative to said first tubular sleeve.

16. A cosmetic container according to claim 13 wherein said shank defines at least one longitudinal slot extending parallel to the longitudinal axis of said second tubular sleeve.

17. A cosmetic container according to claim 16 wherein said shank further defines an integral opening which extends from the proximal end of said shank to said longitudinal slot.

18. A cosmetic container according to claim 16 further comprising a cosmetic carrier including at least one lug extending radially outwardly from said cosmetic carrier, said at least one lug extending through said longitudinal slot of said second tubular sleeve and having a portion thereof received in said helical channel of said first tubular sleeve so that upon rotation of said second tubular sleeve, said cosmetic carrier is propelled longitudinally upwardly or downwardly within said first tubular sleeve.

19. A cosmetic container according to claim 16 wherein said shank defines two longitudinal slots and said at least two ribs extend from one longitudinal slot to the other longitudinal slot so as to be positioned immediately adjacent said at least two longitudinal slots.

20. A cosmetic container according to claim 13 wherein said at least two ribs are disposed between said proximal and distal ends of said shank and are positioned a predetermined distance from said base and said proximal end in a flexible region of said shank.

21. A cosmetic container according to claim 13 wherein each of said at least two ribs has an outer diameter which is at least equal to said inner diameter of said first tubular sleeve for creating torque between said first and second tubular sleeves.

22. A cosmetic container according to claim 21 wherein the outer diameter of each of said at least two ribs is greater than said inner diameter of said first tubular sleeve when said second tubular sleeve is in an unbiased condition wherein said at least two ribs flex inwardly and bear against said first tubular sleeve for creating torque therebetween.

23. A cosmetic container according to claim 13 comprising a cosmetic carrier and said base extends axially beyond said distal end of said first tubular sleeve to define a manually rotatable base so that upon rotation of said manually rotatable base, said cosmetic carrier will be propelled longitudinally upwardly or downwardly within said first tubular sleeve.

24. A cosmetic container comprising:

a first tubular sleeve including a helical channel extending along an inner periphery thereof and having an inner diameter;

a second tubular sleeve having a shank rotatable within said first tubular sleeve, said shank having a proximal and a distal end and defining at least one longitudinal slot extending along a longitudinal axis of said container, said shank having at least one radially, outwardly facing rib having a length which extends substantially perpendicular to said longitudinal slot and said rib extends circumferentially along said shank adjacent said distal end so that said length of said rib extends entirely within a flexible region of said shank for creating torque between said first and second tubular sleeves; and a cosmetic carrier movable longitudinally upwardly or downwardly within said first and second tubular sleeves when said second tubular sleeve is rotated relative to said first tubular sleeve.

25. A cosmetic container according to claim 24 wherein said at least one rib defines an outer diameter which is at least equal to said inner diameter of said first tubular sleeve.

26. A cosmetic container according to claim 24 wherein said at least one rib includes a convex outer surface.

27. A cosmetic container according to claim 24 wherein said at least one radially, outwardly facing rib extends substantially along the entire circumference of an outer surface of said second tubular sleeve.

28. An inner sleeve for a cosmetic container configured to receive a cosmetic carrier comprising a distal and proximal end, a base adjacent the distal end and a shank defined between said base and said proximal end, said shank defining at least one longitudinal slot extending parallel to the longitudinal axis of said inner sleeve so as to define a flexible region within said shank and having at least one rib having a length extending in a circumferential direction and a width extending in an axial direction, said length being greater than said width, and extending outwardly and circumferentially around said shank adjacent said distal end of said shank within said flexible region.

29. An inner sleeve according to claim 28 wherein said at least one rib extends substantially circumferentially around an entire outer surface of said shank.

30. An inner sleeve according to claim 28 wherein said shank further defines an integral opening which extends from the proximal end of said shank to said at least one longitudinal slot.

* * * * *

UNITED STATES PATENT AND TRADEMARK OFFICE
CERTIFICATE OF CORRECTION

PATENT NO. : 5,888,003

DATED : March 30, 1999

INVENTOR(S) : Pierpont

It is certified that error appears in the above-identified patent and that said Letters Patent is hereby corrected as shown below:

Column 7, line 9, "claim 13" should read --claim 20--.

Signed and Sealed this

Seventeenth Day of August, 1999

*Attest:*

*Attesting Officer*

Q. TODD DICKINSON

*Acting Commissioner of Patents and Trademarks*